US011448980B2

(12) United States Patent
Matsui et al.

(10) Patent No.: US 11,448,980 B2
(45) Date of Patent: Sep. 20, 2022

(54) TONER

(71) Applicant: CANON KABUSHIKI KAISHA, Tokyo (JP)

(72) Inventors: Takashi Matsui, Shizuoka (JP); Noritaka Toyoizumi, Shizuoka (JP); Tsutomu Shimano, Shizuoka (JP); Kenji Aoki, Shizuoka (JP); Shohei Shibahara, Shizuoka (JP); Yuna Yamamoto, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 7 days.

(21) Appl. No.: 17/113,922

(22) Filed: Dec. 7, 2020

(65) Prior Publication Data

US 2021/0181646 A1 Jun. 17, 2021

(30) Foreign Application Priority Data

Dec. 12, 2019 (JP) ..... JP2019-224126

(51) Int. Cl.
*G03G 9/087* (2006.01)
*G03G 9/09* (2006.01)

(52) U.S. Cl.
CPC ..... *G03G 9/08711* (2013.01); *G03G 9/091* (2013.01)

(58) Field of Classification Search
CPC ..... G03G 9/08731; G03G 9/091
See application file for complete search history.

(56) References Cited

U.S. PATENT DOCUMENTS

| | | | |
|---|---|---|---|
| 7,678,523 | B2 | 3/2010 | Hiroko et al. |
| 7,842,446 | B2 | 11/2010 | Yanase et al. |
| 7,923,190 | B2 | 4/2011 | Magome et al. |
| 7,935,467 | B2 | 5/2011 | Dojo et al. |
| 8,426,091 | B2 | 4/2013 | Magome et al. |
| 8,426,094 | B2 | 4/2013 | Magome et al. |
| 8,603,712 | B2 | 12/2013 | Aoki et al. |
| 8,614,044 | B2 | 12/2013 | Matsui et al. |
| 8,652,725 | B2 | 2/2014 | Watanabe et al. |
| 8,741,519 | B2 | 6/2014 | Watanabe et al. |
| 8,778,585 | B2 | 7/2014 | Matsui et al. |

(Continued)

FOREIGN PATENT DOCUMENTS

| | | | |
|---|---|---|---|
| JP | 04226473 | A | 8/1992 |
| JP | 2014130243 | A | 7/2014 |
| JP | 2019074727 | A | 5/2019 |

OTHER PUBLICATIONS

U.S. Appl. No. 17/117,223, Tsutomu Shimano, filed Dec. 10, 2020.

*Primary Examiner* — Peter L Vajda
(74) *Attorney, Agent, or Firm* — Venable LLP

(57) ABSTRACT

A toner comprising a toner particle comprising a binder resin and an azo dye, wherein the binder resin comprises a polymer A, the polymer A is a polymer having a monomer unit derived from methacrylonitrile, and a relationship among an amount of substance (mol) of the monomer unit derived from methacrylonitrile, an amount of substance (mol) of the azo dye, and the number of azo groups in the azo dye in the toner particle satisfies formula below:

[(amount of substance of azo dye (mol))×(number of azo groups in azo dye)/(amount of substance of monomer unit derived from methacrylonitrile (mol))]≤0.500.

12 Claims, 1 Drawing Sheet

(56) References Cited

U.S. PATENT DOCUMENTS 8,785,101 B2 7/2014 Kaya et al.
8,841,054 B2 9/2014 Dojo et al.
8,846,284 B2 9/2014 Kinumatsu et al.
8,883,389 B2 11/2014 Matsui et al.
9,097,997 B2 8/2015 Nomura et al.
9,158,216 B2 10/2015 Shimano et al.
9,213,250 B2 12/2015 Nomura et al.
9,217,943 B2 12/2015 Matsui et al.
9,229,345 B2 1/2016 Ikeda et al.
9,239,528 B2 1/2016 Hasegawa et al.
9,304,422 B2 4/2016 Matsui et al.
9,309,349 B2 4/2016 Watanabe et al.
9,348,246 B2 5/2016 Magome et al.
9,354,545 B2 5/2016 Matsui et al.
9,377,705 B2 6/2016 Shimano et al.
9,383,668 B2 7/2016 Noji et al.
9,429,860 B2 8/2016 Kinumatsu et al.
9,442,416 B2 9/2016 Magome et al.
9,442,419 B2 9/2016 Wakabayashi et al.
9,500,972 B2 11/2016 Tanaka et al.
9,575,424 B2 2/2017 Nakagawa et al.
9,581,934 B2 2/2017 Ito et al.
9,599,919 B2 3/2017 Isono et al.
9,625,844 B2 4/2017 Kaya et al.
9,658,546 B2 5/2017 Tanaka et al.
9,658,554 B2 5/2017 Kinumatsu et al.
9,785,068 B2 10/2017 Umeda et al.
9,785,071 B2 10/2017 Shimano et al.
9,798,256 B2 10/2017 Kosaki et al.
9,798,262 B2 10/2017 Toyoizumi et al.
9,811,016 B2 11/2017 Aoki et al.
9,823,595 B2 11/2017 Toyoizumi et al.
9,829,816 B2 11/2017 Tanaka et al.
9,835,964 B2 12/2017 Yoshida et al.
9,857,707 B2 1/2018 Tsuda et al.
9,857,713 B2 1/2018 Kosaki et al.
9,869,943 B2 1/2018 Aoki et al.
9,880,478 B2 1/2018 Shimano et al.
9,904,195 B2 2/2018 Matsui et al.
9,921,501 B2 3/2018 Mochizuki et al.
9,952,523 B2 4/2018 Shimano et al.
10,012,919 B2 7/2018 Matsui et al.
10,114,303 B2 10/2018 Katsura et al.
10,156,800 B2 12/2018 Tsuda et al.
10,197,934 B2 2/2019 Matsui et al.
10,241,430 B2 3/2019 Kimura et al.
10,303,074 B2 5/2019 Yamawaki et al.
10,409,180 B2 9/2019 Koji et al.
10,416,582 B2 9/2019 Nakagawa et al.
10,429,757 B2 10/2019 Yoshida et al.
10,437,165 B2 10/2019 Shimano et al.
10,503,090 B2 12/2019 Tominaga et al.
10,545,422 B2 1/2020 Yamawaki et al.
10,656,545 B2 5/2020 Kamae et al.
10,732,529 B2 8/2020 Yoshiba et al.
10,732,530 B2 8/2020 Matsui et al.
2006/0008721 A1* 1/2006 Hirai ..... G03G 9/0928 430/111.41
2006/0278843 A1* 12/2006 Someda ..... G03G 9/0827 252/62.62
2009/0197192 A1 8/2009 Hiroko et al.
2015/0185658 A1 7/2015 Wakabayashi et al.
2019/0384192 A1 12/2019 Kagawa et al.
2019/0384193 A1 12/2019 Hashimoto et al.
2019/0384195 A1 12/2019 Saeki et al.
2019/0384197 A1 12/2019 Aoki et al.
2019/0384200 A1 12/2019 Kamikura et al.
2019/0384202 A1 12/2019 Shirayama et al.
2020/0041922 A1 2/2020 Shimano et al.
2020/0319567 A1 10/2020 Yoshiba et al.
2020/0356019 A1 11/2020 Matsui et al.
2020/0379363 A1 12/2020 Nagaoka et al.
2021/0026265 A1 1/2021 Kamikura et al.
2021/0026266 A1 1/2021 Toyoizumi et al.

* cited by examiner

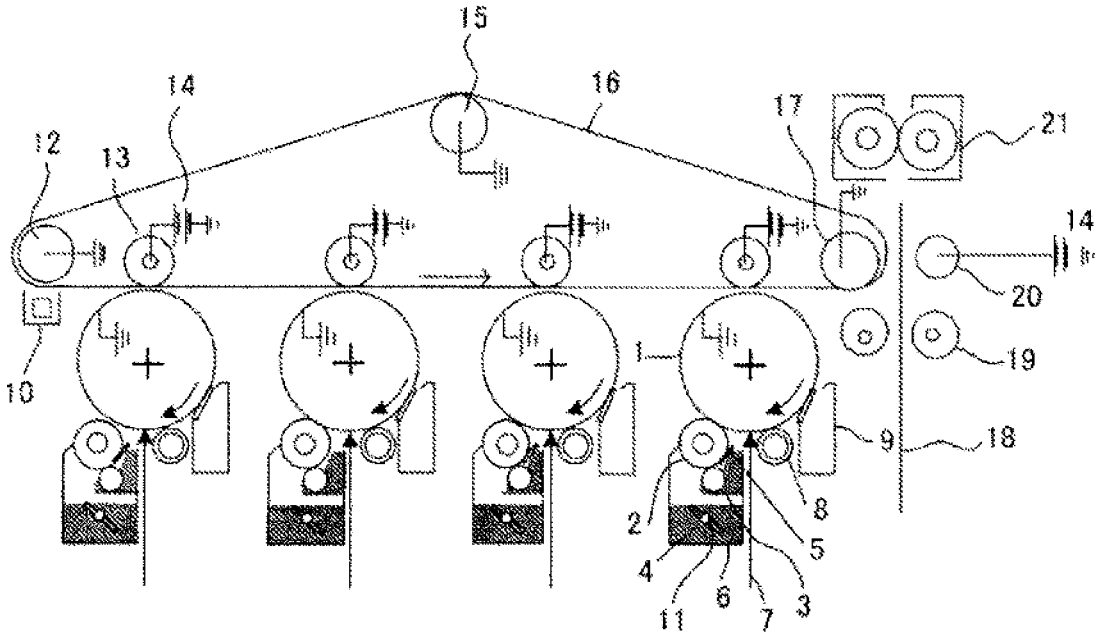
15
14
16
17
21
12
13
14
20
10
1
19
9
18
2
8
5
4
6
3
11
7

TONER

BACKGROUND OF THE INVENTION

Field of the Invention

The present disclosure relates to a toner for use in electrophotography and an electrostatic recording method.

Description of the Related Art

From the viewpoint of improving the image quality of color images, a toner having high tinting strength and a toner exhibiting high image gloss are required. To meet this requirement, various studies have been conducted on binder resins and colorants to be included in such toners.

For example, Japanese Patent Application Publication No. H 04-226473 provides a toner using a binder resin including styrene, acrylonitrile and n-butyl acrylate, and carbon black and nigrosine dye as a colorant.

Further, Japanese Patent Application Publication No. 2014-130243 provides a toner using a binder resin including styrene, acrylonitrile and behenyl acrylate, and carbon black as a colorant.

Further, Japanese Patent Application Publication No. 2019-74727 proposes a toner using a binder resin including styrene, n-butyl acrylate and methacrylic acid, and C.I. Pigment Yellow 155 or C.I. Pigment Yellow 180 as a colorant.

SUMMARY OF THE INVENTION

The toners disclosed in the abovementioned documents certainly tend to improve the tinting strength and image gloss, but it has been found that there is still room for improvement.

In addition, the study conducted by the present inventors found that there is room for improvement also in terms of the problem of achieving both high tinting strength and suppression of transfer roughness in a toner having an azo dye.

The present disclosure is aimed at providing a toner including an azo dye, and achieving both high tinting strength and suppression of transfer roughness, and moreover exhibiting even higher image gloss.

A toner comprising a toner particle comprising a binder resin and an azo dye, wherein the binder resin comprises a polymer A, the polymer A is a polymer having a monomer unit derived from methacrylonitrile, and a relationship among an amount of substance (mol) of the monomer unit derived from methacrylonitrile, an amount of substance (mol) of the azo dye, and the number of azo groups in the azo dye in the toner particle satisfies formula below:

[(amount of substance of azo dye (mol))×(number of azo groups in azo dye)/(amount of substance of monomer unit derived from methacrylonitrile (mop)]≤0.500.

According to the present disclosure, it is possible to provide a toner including an azo dye, and achieving both high tinting strength and suppression of transfer roughness, and moreover exhibiting even higher image gloss.

Further features of the present invention will become apparent from the following description of exemplary embodiments with reference to the attached drawings.

BRIEF DESCRIPTION OF THE DRAWINGS

The figure shows an example of a tandem system image forming apparatus.

DESCRIPTION OF THE EMBODIMENTS

Unless specifically indicated otherwise, the expressions "from XX to YY" and "XX to YY" that show numerical value ranges refer in the present disclosure to numerical value ranges that include the lower limit and upper limit that are the end points.

In the present disclosure, "(meth)acrylate ester" means acrylate ester and/or methacrylate ester.

When the numerical range is described in a stepwise manner, the upper and lower limits of each numerical range can be arbitrarily combined.

The present inventors have found that the above problems can be solved by the following toner.

A toner comprising a toner particle comprising a binder resin and an azo dye, wherein the binder resin comprises a polymer A, the polymer A is a polymer having a monomer unit derived from methacrylonitrile, and a relationship among an amount of substance (mol) of the monomer unit derived from methacrylonitrile, an amount of substance (mol) of the azo dye, and the number of azo groups in the azo dye in the toner particle satisfies formula below:

[(amount of substance of azo dye (mol))×(number of azo groups in azo dye)/(amount of substance of monomer unit derived from methacrylonitrile (mol))]≤0.500.

The present inventors have conducted a study to achieve high tinting strength of the toner by improving the dispersibility of the azo dye in the toner particle.

Methacrylonitrile is represented by the following formula:

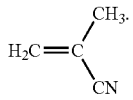

In order to improve the dispersibility of the azo dye, a polymer including a monomer unit having a high affinity with the azo dye was examined. It was found that the dispersibility of the azo dye in the toner was dramatically improved when a structure having a high affinity with the azo dye was evenly arranged in the entire polymer.

The present inventors have also found that a monomer unit having a cyano group has a high affinity with the azo dye. The present inventors assume that this is because the azo group in the azo dye and the cyano group in the polymer interact with each other.

The present inventors have found that the dispersibility of the azo dye in the toner particle is improved and the tinting strength is improved by increasing the affinity between the monomer unit having a cyano group and the azo dye.

However, where, for example, a monomer unit derived from acrylonitrile is used as the monomer unit having a cyano group, another problem is observed that transfer roughness caused by poor transfer failure occurs.

The transfer roughness, as referred to herein, is an image defect in which the on-surface uniformity of an image is deteriorated because untransferred toner is present in some places when an image having a uniform density is outputted.

The apparent reason is the decrease in the charge retention property of the toner, and the present inventors think that this occurs because the electron-withdrawing character of the cyano group deprives the toner of the charge that has been charged thereto.

The study conducted by the present inventors has shown that in order to suppress the electron-attracting character of the cyano group, it is important that a monomer unit have an electron-donating group and the electron-donating group be in close proximity to the cyano group.

That is, it is important that the binder resin have a polymer A, which is a polymer having a monomer unit derived from methacrylonitrile.

The monomer unit derived from methacrylonitrile is represented by the following formula:

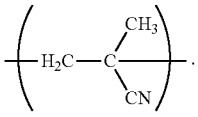

The monomer unit derived from methacrylonitrile has a structure in which the methyl group, which is an electron-donating group, is close to the cyano group, which is an electron-withdrawing group. Therefore, it is considered that the electron-withdrawing character of the cyano group can be efficiently suppressed, and it is expected that the charge retention property of the toner will be improved, which will lead to the suppression of transfer roughness.

It is important that the relationship between the amount of substance (mol) of the monomer unit derived from methacrylonitrile, the amount of substance (mol) of the azo dye, and the number of azo groups in the azo dye (in one molecule of the azo dye) in the toner particle satisfy the following formula.

[(amount of substance of azo dye (mol))×(number of azo groups in azo dye)/(amount of substance of monomer unit derived from methacrylonitrile (mol))]≤0.500.

The polymer A is a polymer obtained by polymerization of a polymerizable monomer composition comprising methacrylonitrile, and a relationship among an amount of substance (mol) of the methacrylonitrile, an amount of substance (mol) of the azo dye, and the number of azo groups in the azo dye in the toner particle satisfies formula below:

[(amount of substance of azo dye (mol))×(number of azo groups in azo dye)/(amount of substance of methacrylonitrile (mol))]≤0.500

Where [(amount of substance of azo dye (mol))×(number of azo groups in azo dye)/(amount of substance of monomer unit derived from methacrylonitrile (mol))] (hereinafter, also referred to as [A×(number of azo groups)/M]) is not more than 0.500, it means that the cyano group derived from methacrylonitrile is sufficiently present with respect to the number of azo groups in the toner particle. Therefore, where it is not more than 0.500, the pigment dispersibility is improved and the abovementioned effect can be exhibited. Where it becomes at least 0.500, the pigment dispersibility decreases.

It is preferable that [A×(number of azo groups)/M] be from 0.010 to 0.050.

Where [A×(number of azo groups)/M] is not more than 0.050, the pigment dispersibility is further improved.

Further, where [A×(number of azo groups)/M] is at least 0.010, the charge retention property is improved and the transfer property can be further suppressed.

[A×(number of azo groups)/M] can be adjusted by the amount of polymer A, the number of monomer units derived from methacrylnitrile, and the type and amount of azo dye in the toner particle.

Next, the amount of the polymer A in the binder resin is preferably at least 50.0% by mass, and more preferably at least 80.0% by mass. The upper limit is not particularly limited, but is preferably not more than 100.0% by mass.

Where the amount of the polymer A in the binder resin is at least 50.0% by mass, the number of monomer units derived from methacrylonitrile increases in the binder resin, so that the pigment dispersibility is likely to be improved. Where the amount of the polymer A in the binder resin is at least 80.0% by mass, the pigment dispersibility is more likely to be improved.

The amount of the monomer unit derived from methacrylonitrile in the polymer A is preferably 10% by mass to 75% by mass, and more preferably 25% by mass to 65% by mass. The amount of the monomer unit derived from methacrylonitrile in the polymer A is preferably f5.0 mol % to 85.0 mol %, and more preferably 25.0 mol % to 70.0 mol %.

Next, the polymer A is preferably a vinyl-based polymer. The polymer A preferably has a monomer unit derived from a vinyl-based monomer represented by the following formula (Z).

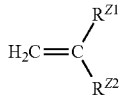

(Z)

[In the formula (Z), $R^{Z1}$ represents a hydrogen atom or an alkyl group (preferably an alkyl group having 1 to 3 carbon atoms, and more preferably a methyl group), and $R^{Z2}$ represents an arbitrary substituent other than the cyano group.]

The monomer unit derived from a vinyl-based monomer represented by the formula (Z) is represented by the following formula:

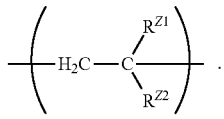

[In the formula, $R^{Z1}$ represents a hydrogen atom or an alkyl group (preferably an alkyl group having 1 to 3 carbon atoms, and more preferably a methyl group), and $R^{Z2}$ represents an arbitrary substituent other than the cyano group.]

Where the polymer A has a unit derived from a vinyl-based monomer that can be represented by the formula (Z), the charge retention property is likely to be improved. Further, this is preferable from the viewpoint of durability, fixability, and storage stability since the brittleness, glass transition temperature, etc. of the polymer A can be adjusted.

$R^{Z2}$ is preferably an alkyl group having 1 to 12 (more preferably 1 to 6) carbon atoms or a phenyl group.

Specific Examples Include:

styrene-based monomers such as styrene, o-methylstyrene, m-methylstyrene, p-methylstyrene, p-methoxystyrene, p-ethylstyrene, and the like;

acrylic acid esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chlorethyl acrylate, phenyl acrylate, and the like;

methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate, and the like; and the like.

In addition, acrylamide and the like can also be mentioned. These can be used alone or in combination of a plurality of same.

Among the above-mentioned polymerizable monomers, it is more preferable to use styrene and/or a styrene derivative alone or in combination with an acrylic acid ester and/or a methacrylic acid ester.

The amount of the monomer unit derived from the vinyl-based monomer represented by the formula (Z) in the polymer A is preferably 5% by mass to 90% by mass, and more preferably 15% by mass to 65% by mass. The amount of the monomer unit derived from methacrylonitrile in the polymer A is preferably 10.0 mol % to 85.0 mol %, and more preferably 15.0 mol % to 70.0 mol %.

In the present disclosure, the "monomer unit" refers to the reacted form of the monomer substance in the polymer. For example, one carbon-carbon bond segment in the main chain in which the vinyl-based monomer in the polymer is polymerized is defined as one unit.

(When calculating the monomer unit, $R^{Z2}$ in the vinyl-based monomer represented by the formula (Z) represents an arbitrary substituent inclusive also of a cyano group.)

The monomer unit derived from methacrylonitrile refers to a monomer unit in which methacrylonitrile has reacted, and indicates a form after the C=C double bond of methacrylonitrile has addition-polymerized. The same applies to a monomer unit derived from the vinyl-based monomer represented by the formula (Z) and a monomer unit derived from a (meth)acrylic acid ester.

The weight average molecular weight (Mw) of the THF-soluble component measured by GPC of the polymer A is preferably from 10,000 to 200,000, and more preferably from 20,000 to 150,000. Where Mw is within the above range, elasticity at around room temperature can be easily maintained, and durability can be easily improved.

Next, examples of the azo dye include aromatic azo compounds. For example, the following can be mentioned.

Examples of a yellow colorant include at least one selected from the group consisting of C.I. Pigment Yellow 13, 14, 17, 62, 74, 81, 83, 93, 94, 95, 97, 111, 116, 120, 128, 150, 151, 154, 155, 165, 168, 180, 183, and 214, and C.I. Solvent Yellow 162.

Examples of a magenta colorant include at least one selected from the group consisting of C.I. Pigment Red 5, 31, 57:1, 144, 146, 147, 150, 166, 170, 176, 178, 185, 220, 221, 238, and 269.

Among these, it is preferable that at least one yellow colorant selected from the group consisting of C.I. Pigment Yellow 17, C.I. Pigment Yellow 74, C.I. Pigment Yellow 93, C.I. Pigment Yellow 151, C.I. Pigment Yellow 155, and C.I. Pigment Yellow 180 is included. With these azo dyes, the pigment dispersibility is more likely to be improved.

The ratio [(molecular weight of the azo dye)/(number of azo groups)] of the molecular weight of the azo dye to the number of azo groups in the azo dye is preferably not more than 500.0, and more preferably not more than 400.0. The lower limit is not particularly limited, but is preferably at least 250.0, and more preferably at least 300.0.

Where [(molecular weight of the azo dye)/(number of azo groups)] is not more than 500.0, it indicates that the number of azo groups in the azo dye is large. Therefore, the affinity with the cyano group in the monomer unit derived from methacrylonitrile tends to be high, so that the pigment dispersibility is likely to be improved.

Next, the molecular weight of the azo dye is preferably not more than 500.0, more preferably not more than 400.0. The lower limit is not particularly limited, but is preferably at least 250.0, and more preferably at least 300.0.

Where the molecular weight of the azo dye is not more than 500.0, the affinity with the cyano group in the monomer unit derived from methacrylonitrile becomes higher, so that the pigment dispersibility is easily improved. In particular, where toner particles are produced in an aqueous medium such as in a suspension polymerization method, the pigment dispersibility is likely to be improved.

The amount of the azo dye with respect to 100 parts by mass of the binder resin is preferably 1 part by mass to 20 parts by mass, and more preferably 2 parts by mass to 10 parts by mass with respect to the binder resin. Where the amount is at least 1 part by mass, the tinting strength is improved. Meanwhile, where the amount is not more than 20 parts by mass, the pigment dispersibility is likely to be improved, for example, when the toner particles are produced in an aqueous medium such as in a suspension polymerization method.

Next, it is preferable that the polymer A have a monomer unit derived from at least one selected from the group consisting of (meth)acrylic acid esters having an alkyl group having 18 to 36 carbon atoms.

Where the polymer A has a monomer unit derived from at least one selected from the group consisting of (meth)acrylic acid esters having an alkyl group having 18 to 36 carbon atoms, the sharp melt property of the toner can be easily improved and fixing gloss is easily improved.

Where the number of carbon atoms is at least 18, it becomes easy to increase the melting point of the toner, and the storage stability is improved. Further, where the number of carbon atoms is not more than 36, the crystallization rate tends to increase, so that the back surface of the paper after fixing is less likely to be soiled.

The amount of the monomer unit derived from at least one selected from the group consisting of (meth)acrylic acid esters having an alkyl group having 18 to 36 carbon atoms in the polymer A is preferably 1.0 mol % to 50.0 mol %, and more preferably 1.0 mol % to 25.0 mol %. Where the amount is at least 1.0 mol %, the fixing gloss is likely to be improved. Meanwhile, where the amount is not more than 50.0 mol %, the pigment dispersibility is likely to be improved.

Further, the amount of the monomer unit derived from at least one selected from the group consisting of (meth)acrylic acid esters having an alkyl group having 18 to 36 carbon atoms in the polymer A is preferably 1% by mass to 75% by mass, and more preferably 3% by mass to 55% by mass.

The (meth)acrylate esters having an alkyl group having 18 to 36 carbon atoms can be exemplified by (meth)acrylate esters having a linear alkyl group having 18 to 36 carbon atoms [e.g., stearyl (meth)acrylate, nonadecyl (meth)acrylate, eicosyl (meth)acrylate, heneicosyl (meth)acrylate, behenyl (meth)acrylate, lignoceryl (meth)acrylate, ceryl (meth)acrylate, octacosyl (meth)acrylate, myricyl (meth) acrylate, and dotriacontyl (meth)acrylate] and by (meth) acrylate esters having a branched alkyl group having 18 to 36 carbon atoms [e.g., 2-decyltetradecyl (meth)acrylate].

Of these, from the viewpoint of storage stability of the toner and fixing gloss, it is preferably at least one selected from the group consisting of (meth)acrylic acid esters having a linear alkyl group having 18 to 30 carbon atoms, more preferably at least one selected from the group consisting of (meth)acrylic acid esters having a linear alkyl group having 18 to 24 carbon atoms, and even more preferably at least one selected from the group consisting of linear stearyl (meth) acrylate and behenyl (meth)acrylate.

Next, other materials used for the toner will be described in detail.

Binder Resin

In addition to the polymer A, the binder resin may include a known resin such as a vinyl resin, a polyester resin, a polyurethane resin, or an epoxy resin to the extent that the effects of the present disclosure are not impaired.

Among them, a vinyl resin, a polyester resin, and a polyurethane resin are preferable from the viewpoint of electrophotographic characteristics.

Examples of the polymerizable monomer that can be used for a vinyl resin include the vinyl monomers that can be represented by the above formula (Z).

(Z)

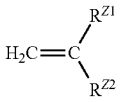

[In the formula (Z), $R^{Z1}$ represents a hydrogen atom or an alkyl group (preferably an alkyl group having 1 to 3 carbon atoms, and more preferably a methyl group), and $R^{Z2}$ represents an arbitrary substituent other than the cyano group.]

$R^{Z2}$ is preferably an alkyl group having 1 to 12 (more preferably 1 to 6) carbon atoms or a phenyl group.

If necessary, at least two types may be used in combination.

The polyester resin can be obtained by the reaction of at least a dibasic polybasic carboxylic acid with a polyhydric alcohol.

The following compounds are examples of polybasic carboxylic acids: dibasic acids such as succinic acid, adipic acid, sebacic acid, phthalic acid, isophthalic acid, terephthalic acid, malonic acid, and dodecenylsuccinic acid, and their anhydrides and lower alkyl esters, aliphatic unsaturated dicarboxylic acids such as maleic acid, fumaric acid, itaconic acid, and citraconic acid; 1,2,4-benzenetricarboxylic acid and 1,2,5-benzenetricarboxylic acid and their anhydrides and lower alkyl esters. A single one of these may be used by itself or two or more may be used in combination.

The polyhydric alcohol can be exemplified by the following compounds:

alkylene glycols (ethylene glycol, 1,2-propylene glycol, and 1,3-propylene glycol), alkylene ether glycols (polyethylene glycol and polypropylene glycol), alicyclic diols (1,4-cyclohexanedimethanol), bisphenols (bisphenol A), and alkylene oxide (ethylene oxide or propylene oxide) adducts on alicyclic diols and bisphenols. The alkyl moiety of the alkylene glycol and the alkylene ether glycol may be linear or branched. Other examples include glycerin, trimethylolethane, trimethylolpropane and pentaerythritol and the like. These may be used alone or in combination of at least two.

As necessary, a monovalent acid such as acetic acid or benzoic acid and a monohydric alcohol such as cyclohexanol or benzyl alcohol may also be used for the purpose of adjusting the acid value or hydroxyl value.

There are no particular limitations on the method for producing the polyester resin, but, for example, a transesterification method or direct polycondensation method, each as such or in combination, may be used.

The polyurethane resin is considered in the following. The polyurethane resin is the reaction product of a diol with a substance that contains the diisocyanate group, and resins having various functionalities can be obtained by adjusting the diol and diisocyanate.

The diisocyanate component can be exemplified by the following: aromatic diisocyanates having from 6 to 20 carbon atoms (excluding the carbon in the NCO group, the same applies in the following), aliphatic diisocyanates having from 2 to 18 carbon atoms, and alicyclic diisocyanates having from 4 to 15 carbon atoms, as well as modifications of these diisocyanates (modifications that contain the urethane group, carbodiimide group, allophanate group, urea group, biuret group, uretdione group, uretoimine group, isocyanurate group, or oxazolidone group, also referred to herebelow as "modified diisocyanate") and mixtures of two or more of the preceding.

The following are examples of the aromatic diisocyanates: m- and/or p-xylylene diisocyanate (XDI) and α, α, α', α'-tetramethylxylylene diisocyanate.

The following are examples of the aliphatic diisocyanates: ethylene diisocyanate, tetramethylene diisocyanate, hexamethylene diisocyanate (HDI), and dodecamethylene diisocyanate.

The following are examples of the alicyclic diisocyanates: isophorone diisocyanate (IPDI), dicyclohexylmethane-4,4'-diisocyanate, cyclohexylene diisocyanate, and methylcyclohexylene diisocyanate.

Preferred among the preceding are aromatic diisocyanates having from 6 to 15 carbon atoms, aliphatic diisocyanates having from 4 to 12 carbon atoms, and alicyclic diisocyanates having from 4 to 15 carbon atoms, wherein XDI, IPDI, and HDI are particularly preferred.

A trifunctional or higher functional isocyanate compound may also be used in addition to the diisocyanate component.

The same dihydric alcohols usable for the polyester resin as described can be adopted for the diol component that can be used for the polyurethane resin.

<Wax>

The toner particle may contain a wax.

The wax can be exemplified by the following: esters between a monohydric alcohol and a monocarboxylic acid, e.g., behenyl behenate, stearyl stearate, and palmityl palmitate; esters between a dibasic carboxylic acid and a monoalcohol, e.g., dibehenyl sebacate; esters between a dihydric alcohol and a monocarboxylic acid, e.g., ethylene glycol distearate and hexanediol dibehenate; esters between a trihydric alcohol and a monocarboxylic acid, e.g., glycerol tribehenate; esters between a tetrahydric alcohol and a monocarboxylic acid, e.g., pentaerythritol tetrastearate and pentaerythritol tetrapalmitate; esters between a hexahydric alcohol and a monocarboxylic acid, e.g., dipentaerythritol hexastearate and dipentaerythritol hexapalmitate; esters between a polyfunctional alcohol and a monocarboxylic acid, e.g., polyglycerol behenate; natural ester waxes such as carnauba wax and rice wax; petroleum-based hydrocarbon waxes, e.g., paraffin wax, microcrystalline wax, and petrolatum, and derivatives thereof; hydrocarbon waxes provided by the Fischer-Tropsch process and derivatives thereof; polyolefin-type hydrocarbon waxes, e.g., polyethylene wax and polypropylene wax, and their derivatives; higher aliphatic alcohols; fatty acids such as stearic acid and palmitic acid; and acid amide waxes.

The amount of wax in the toner particle is preferably from 1.0% by mass to 30.0% by mass, and more preferably from 2.0% by mass to 25.0% by mass.

<Polymerization Initiator>

A polymerization initiator may be used to obtain the polymer A. Known polymerization initiators can be used without particular limitation.

The following are specific examples: peroxide-type polymerization initiators such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, pertriphenylacetic acid-tert-hydroperoxide, tert-butyl performate, tert-butyl peracetate, tert-butyl perbenzoate, tert-butyl perphenylacetate, tert-butyl permethoxyacetate, per-N-(3-toluyl)palmitic acid-tert-butylbenzoyl peroxide, t-butyl peroxy-2-ethylhexanoate, t-butyl peroxypivalate, t-butyl peroxyisobutyrate, t-butyl peroxyneodecanoate, methyl ethyl ketone peroxide, diisopropyl peroxycarbonate, cumene hydroperoxide, 2,4-dichlorobenzoyl peroxide, and lauroyl peroxide; and azo and diazo polymerization initiators as represented by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

<Colorant>

The toner may include a colorant other than the above-mentioned azo dye.

The heretofore known magnetic material and pigments and dyes in the colors of black, yellow, magenta, and cyan as well as in other colors may be used without particular limitation as this colorant.

The content of the colorant is preferably from 1.0 mass parts to 20.0 mass parts per 100.0 mass parts of the binder resin.

The toner may also be made into a magnetic toner through the incorporation of a magnetic material. In this case, the magnetic material may also function as a colorant.

The magnetic material can be exemplified by iron oxides as represented by magnetite, hematite, and ferrite; metals as represented by iron, cobalt, and nickel; alloys of these metals with a metal such as aluminum, cobalt, copper, lead, magnesium, tin, zinc, antimony, beryllium, bismuth, cadmium, calcium, manganese, selenium, titanium, tungsten, and vanadium; and mixtures thereof.

When a magnetic material is used, its content is preferably 40.0 mass parts to 150.0 mass parts per 100.0 mass parts of the binder resin.

<Charge Control Agent>

The toner may contain a charge control agent.

The heretofore known charge control agents may be used without particular limitation as this charge control agent. Negative-charging charge control agents can be specifically exemplified by metal compounds of aromatic carboxylic acids such as salicylic acid, alkylsalicylic acid, dialkylsalicylic acid, naphthoic acid, and dicarboxylic acids, and by polymers and copolymers bearing such a metal compound of an aromatic carboxylic acid; polymers and copolymers bearing a sulfonic acid group, sulfonate salt group, or sulfonate ester group; metal salts and metal complexes of azo dyes and azo pigments; and boron compounds, silicon compounds, and calixarene.

The positive-charging charge control agents can be exemplified by quaternary ammonium salts and polymeric compounds that have a quaternary ammonium salt in side chain position; guanidine compounds; nigrosine compounds; and imidazole compounds.

The polymers and copolymers bearing a sulfonate salt group or sulfonate ester group can be exemplified by homopolymers of a sulfonic acid group-containing vinyl monomer such as styrenesulfonic acid, 2-acrylamido-2-methylpropanesulfonic acid, 2-methacrylamido-2-methylpropanesulfonic acid, vinylsulfonic acid, and methacrylsulfonic acid, and by copolymers of these sulfonic acid group-containing vinyl monomers with vinyl monomer as indicated in the section on the binder resin.

The content of the charge control agent is preferably from 0.01 mass parts to 5.0 mass parts per 100.0 mass parts of the binder resin.

<External Additive>

The toner may contain an external additive.

The heretofore known external additives may be used without particular limitation as this external additive. Specific examples are as follows: base silica fine particles, e.g., silica produced by a wet method or silica produced by a dry method; silica fine particles provided by subjecting such base silica fine particles to a surface treatment with a treatment agent such as a silane coupling agent, titanium coupling agent, silicone oil, and so forth; and resin fine particles such as vinylidene fluoride fine particles, polytetrafluoroethylene fine particles, and so forth.

The content when the external additive is incorporated is preferably from 0.1 mass parts to 5.0 mass parts per 100.0 mass parts of the toner particle.

Methods for producing the toner are described in detail in the following.

A heretofore known method, e.g., a suspension polymerization method, dissolution suspension method, emulsion aggregation method, or pulverization method, can be used as the method for producing the toner; however, the toner production method is not limited to these. These methods can be broadly classified into suspension polymerization, in which the toner is produced at the same time as polymer production, and dissolution suspension, emulsion aggregation, and pulverization, in which the toner is produced using a separately produced polymer.

Methods for obtaining the toner by suspension polymerization and by emulsion aggregation are described in the following as examples.

<Method of Toner Production by Suspension Polymerization>

Dispersion Step)

A polymerizable monomer composition including methacrylonitrile and, if necessary, a vinyl-based monomer represented by the formula (Z) and another vinyl-based monomer such as a (meth)acrylic acid ester having an alkyl group having 18 to 36 carbon atoms, an azo dye, and various materials as needed are added, and a disperser is used to melt, dissolve, or disperse these to prepare a raw material dispersion.

The colorant, wax, and charge control agent described in the sections on the materials, solvent in order to adjust the viscosity, and other additives may optionally be added as appropriate. The solvent for viscosity adjustment should be solvent that has a low solubility in water and that can thoroughly dissolve/disperse the aforementioned materials, but is not otherwise particularly limited and known solvents can be used. Examples are toluene, xylene, and ethyl acetate. The disperser can be exemplified by homogenizers, ball mills, colloid mills, and ultrasound dispersers.

Granulation Step)

The starting material dispersion is introduced into a preliminarily prepared aqueous medium and a suspension is prepared using a disperser such as a high-speed stirrer or an ultrasound disperser. The aqueous medium preferably contains a dispersion stabilizer in order to adjust the particle diameter and inhibit aggregation. The dispersion stabilizer is not particularly limited and heretofore known dispersion stabilizers can be used.

The following are examples of inorganic dispersion stabilizers: phosphate salts as represented by tribasic calcium phosphate, dibasic calcium phosphate, magnesium phosphate, aluminum phosphate, and zinc phosphate; carbonates as represented by calcium carbonate and magnesium carbonate; metal hydroxides as represented by calcium hydroxide, magnesium hydroxide, and aluminum hydroxide; sulfate salts as represented by calcium sulfate and barium sulfate; as well as calcium metasilicate, bentonite, silica, and alumina.

The following are examples of organic dispersion stabilizers: polyvinyl alcohol, gelatin, methyl cellulose, methyl hydroxypropyl cellulose, ethyl cellulose, the sodium salt of carboxymethyl cellulose, polyacrylic and salts thereof, and starch.

Due to their high charge polarization and strong adsorptive strength for oil phases, inorganic charge stabilizers exhibit a strong aggregation-inhibiting action and are thus preferred. In addition, hydroxyapatite, tribasic calcium phosphate, and dibasic calcium phosphate are more preferred because they can be easily removed by adjusting the pH.

Polymerization Step)

A toner particle containing polymer A is obtained by polymerizing the polymerizable monomer in the suspension.

A polymerization initiator may be used in the polymerization step. The polymerization initiator may be admixed together with the other additives during preparation of the starting material dispersion or may be mixed into the starting material dispersion immediately before suspension in the aqueous medium. In addition, as necessary it may also be added, dissolved in polymerizable monomer or another solvent, during the granulation step or after completion of the granulation step, i.e., immediately before the initiation of the polymerization step. After the polymer has been obtained by the polymerization of the polymerizable monomer, an aqueous dispersion of toner particles is obtained as necessary by carrying out a solvent removal process by the application of heat or reduced pressure.

When a highly hydrophilic amorphous resin has been added to the starting material dispersion, the amorphous resin migrates to the toner particle surface layer from the granulation step through the polymerization step to form the shell layer.

(Filtration Step, Washing Step, Drying Step, Classification Step, External Addition Step)

A toner particle is obtained by the execution of a filtration step in which a solid fraction is obtained by solid-liquid separation from the aqueous toner particle dispersion, an optional washing step, a drying step, and a classification step in order to adjust the granulometry. This toner particle may be used as such as toner. A toner may also be obtained as necessary by attaching an external additive, e.g., an inorganic fine powder, to the toner particle by mixing the external additive and the toner particle using a mixer.

<Method of Toner Production by Emulsion Aggregation>

(Polymer Production Step)

A heretofore known production method, e.g., solution polymerization, suspension polymerization, emulsion polymerization, bulk polymerization, dispersion polymerization, and so forth, may be used as the method for producing the polymer, but there is no limitation to these.

A method for obtaining the polymer by solution polymerization is described as an example in the following.

A monomer solution in which a polymerizable monomer composition including methacrylonitrile and, if necessary, another vinyl-based monomer is dissolved in a solvent such as toluene is prepared. The polymerization initiator is added to this, and a polymer solution of the polymer dissolved in the solvent, e.g., toluene, is then obtained by polymerizing the polymerizable monomer. The polymer A is precipitated by mixing the polymer solution with a solvent (e.g., methanol) in which the polymer is insoluble. The precipitated polymer A is filtered and washed to obtain the polymer A.

(Resin Fine Particle Dispersion Preparation Step)

The dispersion of resin fine particles can be prepared by known methods, but there is no limitation on these methods. Examples are emulsion polymerization; self-emulsification; phase inversion emulsification, in which the resin is emulsified by the addition of an aqueous medium to a solution of the resin dissolved in an organic solvent; and forced emulsification, in which the resin is forcibly emulsified, without the use of an organic solvent, by carrying out a high-temperature treatment in an aqueous medium.

A method of preparing the resin fine particle dispersion using phase inversion emulsification is described in the following as an example.

The polymer-containing resin component is dissolved in an organic solvent in which the resin component dissolves and a surfactant and/or a basic compound is added. If the resin component is a crystalline resin having a melting point, dissolution should be carried out by heating to or above the melting point. Then, while performing stirring with, e.g., a homogenizer, an aqueous medium is gradually added to precipitate resin fine particles. This is followed by removal of the solvent by the application of heat or reduced pressure to produce an aqueous dispersion of resin fine particles.

The organic solvent used to dissolve the polymer A-containing resin component should be able to dissolve the polymer A-containing resin component. Specific examples are toluene and xylene.

There are no particular limitations on the surfactant used in the preparation step, and the following are examples: anionic surfactants such as the salts of sulfate esters, sulfonate salts, carboxylate salts, phosphate esters, and soaps; cationic surfactants such as amine salts and quaternary ammonium salts; and nonionic surfactants such as polyethylene glycols, ethylene oxide adducts on alkylphenols, and polyhydric alcohol systems. A single surfactant may be used by itself or two or more may be used in combination.

The basic compound used in the preparation step can be exemplified by inorganic bases such as sodium hydroxide and potassium hydroxide and by ammonia and organic bases such as triethylamine, trimethylamine, dimethylaminoethanol, and diethylaminoethanol. A single basic compound may be used by itself or two or more may be used in combination.

(Preparation of Colorant Dispersion Such as an Azo Dye)

Known dispersion methods can be used to prepare the colorant dispersion such as an azo dye, and, for example, a common dispersion means can be used without any limitation whatsoever, e.g., a homogenizer, ball mill, colloid mill, ultrasound disperser, and so forth. The surfactants indicated above are examples of surfactants that can be used for this dispersion.

(Preparation of Wax Dispersion)

A wax-dispersed solution is prepared as needed. The wax dispersion is prepared by dispersing a wax in water in combination with, e.g., a surfactant and/or a basic compound, followed by heating to a temperature equal to or greater than the melting point of the wax while carrying out a dispersion process using a disperser or homogenizer that can apply a strong shear force. The execution of this process yields a wax dispersion. The surfactant used for dispersion here can be exemplified by the surfactants already described above. The basic compound used for dispersion here can also be exemplified by the basic compounds already described above.

(Aggregated Particle Formation Step)

In the aggregated particle formation step, a mixture is first made by mixing the resin fine particle dispersion, the colorant dispersion, the wax dispersion, and so forth as needed. Aggregation is then induced by bringing the pH into the acidic region while heating at a temperature below the melting point of the resin fine particles, thus obtaining an aggregated particle dispersion through the formation of aggregated particles that contain resin fine particles, colorant particles, and wax particles.

(First Fusion Step)

In the first fusion step, while operating under stirring conditions that conform to the aggregated particle formation step, the development of aggregation is halted by raising the pH of the aggregated particle dispersion, and a fused particle dispersion is obtained by heating to a temperature equal to or greater than the melting point of the previously the polymer A.

(Step of Amorphous Resin Fine Particle Attachment)

Amorphous resin fine particles may be attached to the obtained fused particles, if necessary. In the step of amorphous resin fine particle attachment, a dispersion of resin-attached particles is obtained by adding an amorphous resin particle dispersion to the fused particle dispersion and inducing attachment of the amorphous resin fine particles to the surface of the fused particles by dropping the pH.

Here, this coating layer corresponds to the shell layer that is formed by the execution of the shell layer formation steps that are described below. The amorphous resin fine particle dispersion can be produced in accordance with the previously described resin fine particle dispersion preparation step.

(Second Fusion Step)

In the second fusion step, the progress of aggregation is stopped by raising the pH of the resin-attached particle-dispersed solution according to the first fusion step, and the resin-attached particles are fused by performing heating at a temperature equal to at least the inching point of the polymer to obtain a toner particle having a formed shell layer.

(Filtration Step, Washing Step, Drying Step, Classification Step, External Addition Step)

A toner particle is obtained by the subsequent execution of a filtration step in which a toner particle solid fraction is separated off by filtration and the execution of an optional washing step, a drying step, and a classification step in order to adjust the granulometry. This toner particle may be used as such as toner. A toner may also be obtained as necessary by attaching an external additive, e.g., an inorganic fine powder, to the toner particle by mixing the external additive and the toner particle using a mixer.

<Other Methods for Forming Shell Layer>

Formation of the shell layer at the same time as toner particle production as described above can be used with the suspension polymerization method and emulsion aggregation method. Shell layer formation by the same method as for the suspension polymerization method is also possible with the dissolution suspension method.

In other methods, the shell layer can be formed after the toner core has been formed. Examples are described in the following of a method in which shell layer formation is carried out by emulsion aggregation on an aqueous dispersion of the toner core (the toner core dispersion in the following); however, there is no limitation to these.

<Shell Layer Formation by Emulsion Aggregation>

The shell layer can be formed by executing, on the toner core dispersion, the same procedures as in the step of amorphous resin fine particle attachment and the second fusion step in the above-described method of toner production by emulsion aggregation.

A toner particle is then obtained by the execution of a filtration step in which a toner particle solid fraction is separated off by filtration and the execution of an optional washing step, a drying step, and a classification step in order to adjust the granulometry.

Next, methods for measuring physical properties will be described. <Measurement of Weight-Average Particle Diameter (D4) and Number-Average Particle Diameter (D1) of Toner>

The weight-average particle diameter (D4) and the number-average particle diameter (D1) of the toner are determined proceeding as follows. The measurement instrument used is a "Coulter Counter Multisizer 3" (registered trademark, Beckman Coulter, Inc.), a precision particle size distribution measurement instrument operating on the aperture impedance method and equipped with a 100 μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of 1.0% and, for example, "ISOTON II" (Beckman Coulter, Inc.) can be used.

The dedicated software is configured as follows prior to measurement and analysis.

In the "modify the standard operating method (SOMME)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1,600 μA; the gain is set to 2; the electrolyte solution is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) 200.0 mL of the aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) 30.0 mL of the aqueous electrolyte solution is introduced into a 100-mL flatbottom glass beaker. To this is added as dispersing agent 0.3 mL of a dilution prepared by the three-fold (mass) dilution with deionized water of "Contaminon N" (a 10% aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetra 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. 3.3 L of deionized water is introduced into the water tank of the ultrasound disperser and 2.0 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the toner particle is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the aqueous electrolyte solution prepared in (5) and containing dispersed toner particles, is dripped into the roundbottom beaker set in the sample stand as described in (1) with adjustment to provide a measurement concentration of 5%. Measurement is then performed until the number of measured particles reaches 50,000.

(7) The measurement data is analyzed by the dedicated software provided with the instrument and the weight-average particle diameter (D4) and the number-average particle diameter (D1) are calculated. When set to graph/volume % with the dedicated software, the "average diameter" on the "analysis/volumetric statistical value (arithmetic average)" screen is the weight-average particle diameter (D4). When set to graph/number % with the dedicated software, the "average diameter" on the "analysis/numerical statistical value (arithmetic average)" screen is the number-average particle diameter (D1).

<Method for Measuring Content Ratio of Monomer Units Derived from Various Polymerizable Monomers in Polymer A>

The content ratio of monomer units derived from various polymerizable monomers in the polymer A is measured by $^{1}$H—NMR under the following conditions. Measuring device: FT NMR device JNM-EX400 (manufactured by JEOL Ltd.)

Measurement frequency: 400 MHz
Pulse condition: 5.0 μs
Frequency range: 10,500 Hz
Accumulation number: 64 times
Measurement temperature: 30° C.
Sample: 50 mg of the measurement sample is placed in a sample tube having an inner diameter of 5 mm, deuterated chloroform ($CDCl_3$) is added as a solvent, and this is dissolved in a constant temperature bath at 40° C. to prepare a sample.

From the obtained $^{1}$H—NMR chart, among the peaks attributed to the components of the monomer unit derived from methacrylonitrile, a peak independent of the peaks attributed to the components of the monomer units derived from other sources is selected and the integrated value S1 of this peak is calculated.

Similarly, among the peaks attributed to the components of the monomer unit derived from the monomer represented by the formula (Z), a peak independent of the peaks attributed to the components of the monomer units derived from polymerizable monomers different from the monomer represented by the formula (Z) is selected and the integrated value S2 of this peak is calculated.

Further, where a (meth)acrylic acid ester having an alkyl group having 18 to 36 carbon atoms is used, from the peaks attributed to the components of the monomer unit derived from the (meth)acrylic acid ester, a peak independent of the peaks attributed to the components of the other derived monomer units is selected and the integrated value S3 of this peak is calculated.

The content ratio of the monomer unit derived from methacrylonitrile is determined as follows using the integrated values S1, S2, and S3. In addition, n1, n2, and n3 are the numbers of hydrogen atoms in the components to which the peaks of interest in the respective segments on each site are attributed.

The ratio of the monomer unit derived from methacrylonitrile (mol %)={(S1/n1)/((S1/n1)+(S2/n2)+(S3/n3))}×100.

Similarly, the ratio of the monomer unit derived from the monomer represented by the formula (Z) and the monomer unit derived from the (meth)acrylic acid ester having an alkyl group having 18 to 36 carbon atoms is determined as follows.

The ratio of the monomer unit derived from the monomer represented by the formula (Z) (mol %)={(S2/n2)/((S1/n1)+(S2/n2)+(S3/n3))}×100.

The ratio of the monomer unit derived from the (meth) acrylic acid ester having an alkyl group having 18 to 36 carbon atoms (mol %)={(S3/n3)/((S1/n1)+(S2/n2)+(S3/n3))}×100.

Where a polymerizable monomer containing no hydrogen atoms is used in the component other than the vinyl group in the polymer A, the measurement atomic nucleus is set to $^{13}$C by using $^{13}$C—NMR, the measurement is performed in a single pulse mode, and the calculation is performed in the same manner as in $^{1}$H—NMR.

Further, where the toner is produced by the suspension polymerization method, the peaks of the release agent and another resin may overlap, and independent peaks may not be observed. As a result, the content ratio of the monomer units derived from various polymerizable monomers in the polymer A may not be calculated. In that case, a polymer A' can be produced by performing the same suspension polymerization without using a release agent or other resin, and the analysis can be conducted by considering the polymer A' as the polymer A.

<Structure (NMR) of Colorant Such as Azo Dye>

The structure of the colorant such as an azo dye is analyzed by nuclear magnetic resonance spectroscopy ($^1$H—NMR).

Measuring device: JNM-EX400 (manufactured by JEOL Ltd.)
Measurement frequency: 400 MHz
Pulse condition: 5.0 μs
Frequency range: 10,500 Hz
Accumulation number: 1024 times
Measuring solvent: DMSO-d6

The sample is dissolved in DMSO-d6 as much as possible, and the measurement is performed under the above-mentioned conditions. The structure of the sample is calculated from the chemical shift value and proton ratio of the obtained spectrum.

<Measurement of Amount of Colorant Such as Azo Dye>

For measuring the amount of the colorant such as an azo dye in the toner, for example, a measuring device "RINT-TTRII" (manufactured by Rigaku Co., Ltd.) and control software and analysis software provided with the device can be used as an X-ray diffractometer.

The measurement conditions are as follows.

X-ray: Cu/50 kV/300 mA
Goniometer: rotor horizontal goniometer (TTR-2)
Attachment: standard sample holder
Divergence slit: release
Divergence vertical limitation slit: 10.00 mm
Scattering slit: open
Light-receiving slit: open
Counter: scintillation counter
Scan mode: continuous
Scan speed: 4.0000°/min.
Sampling width: 0.0200°
Scanning axis: 2θ/θ
Scanning range: 10.000° to 40.0000°

The target toner is set on a sample plate to start the measurement. The measurement with CuKα characteristic X-rays is performed in a Bragg angle (2θ±0.20 deg) range of 3 deg to 35 deg, and the integrated intensity of the spectrum other than that derived from the colorant such as an azo dye is subtracted from the total integrated intensity of the obtained spectrum, thereby determining the amount of the colorant in the toner.

<Method for Measuring Glass Transition Temperature Tg>

The glass transition temperature Tg is measured according to ASTM D3418-82 by using a differential scanning calorimeter "Q2000" (manufactured by TA Instruments). The melting points of indium and zinc are used for temperature correction of the device detector, and the heat of fusion of indium is used for the correction of calorific value.

Specifically, about 2 mg of a sample is precisely weighed, placed in an aluminum pan, an empty aluminum pan is used as a reference, and measurement is performed at a temperature rise rate of 10° C./min in the measurement temperature range of −10° C. to 200° C. In the measurement, the temperature is raised to 200° C., then lowered to −10° C., and then raised again. The specific heat change is obtained in the temperature range of 30° C. to 100° C. in the second temperature raising process. The intersection of the line at the midpoint of the baseline before and after the specific heat change at this time and the differential thermal curve is defined as the glass transition temperature Tg.

<Method for Measuring of Molecular Weight of Resin Such as Polymer A>

The molecular weight (weight average molecular weight Mw, number average molecular weight Mn) of the THF-soluble component of the resin such as the polymer A is measured by gel permeation chromatography (GPC) in the following manner.

First, the sample is dissolved in tetrahydrofuran (THF) at room temperature for 24 h. Then, the obtained solution is filtered through a solvent-resistant membrane filter "Myshori Disc" (manufactured by Tosoh Corporation) having a pore diameter of 0.2 μm to obtain a sample solution. The sample solution is adjusted so that the concentration of the component soluble in THF is 0.8% by mass. This sample solution is used for measurement under the following conditions.

Device: HLC8120 GPC (detector: RI) (manufactured by Tosoh Corporation)
Column: 7 types, Shodex KF-801, 802, 803, 804, 805, 806, 807 (manufactured by Showa Denko KK)
Eluent: tetrahydrofuran (THF)
Flow velocity: 1.0 ml/min
Oven temperature: 40.0° C.
Sample injection amount: 0.10 ml In calculating the molecular weight of the sample, molecular weight calibration curve prepared using standard polystyrene resin (for example, trade name "TSK Standard Polystyrene F-850, F-450, F-288, F-128, F-80, F-40, F-20, F-10, F-4, F-2, F-1, A-5000, A-2500, A-1000, A-500", manufactured by Tosoh Corporation) is used.

EXAMPLES

Hereinafter, the present invention will be specifically described with reference to Examples, but this does not limit the present invention in any way. In the following formulations, parts are based on mass unless otherwise noted.

Preparation of Amorphous Resin 1

The following raw materials were loaded into a heat-dried two-necked flask while introducing nitrogen.

| | |
|---|---|
| Polyoxypropylene (2.2)-2,2-bi (4-hydroxyphenyl)propane | 30.00 parts |
| Polyoxyethylene (2.2)-2,2-bis (4-hydroxyphenyl)propane | 33.00 parts |
| Terephthalic acid | 21.00 parts |
| Dodecenylsuccinic acid | 15.00 parts |
| Dibutyltin oxide | 0.10 parts |

After replacing the inside of the system with nitrogen by a depressurization operation, stirring was performed at 215° C. for 5 h. Then, the temperature was gradually raised to 230° C. under reduced pressure while continuing stirring, and the temperature was maintained for another 2 h. An amorphous resin 1 which is an amorphous polyester was synthesized by air-cooling and stopping the reaction when a viscous state was assumed. The amorphous resin 1 had Mn of 5200, Mw of 23000, and Tg of 55° C.

Example 1

Production of Toner Particles 1

| | |
|---|---|
| Methacrylonitrile | 30.0 parts (45.9 mol %) |
| Styrene | 35.0 parts (34.1 mol %) |

-continued

| | |
|---|---|
| Butyl acrylate | 25.0 parts (20.0 mol %) |
| C.I. Pigment Yellow 74 (molecular weight 372.4) | 4.0 parts |
| Aluminum di-t-butylsalicylate | 1.00 part |
| Fischer-Tropsch Wax (HNP-51, melting point Tm: 74° C., Nippon Seiro Co., Ltd.) | 5.0 parts |

This mixture was introduced into an attritor (Nippon Coke & Engineering Co., Ltd.), and a starting material dispersion was obtained by dispersing for 2 hours at 200 rpm using zirconia beads having a diameter of 5 mm.

Otherwise, 735.00 parts of deionized water and 16.00 parts of trisodium phosphate (dodecahydrate) were added to a vessel equipped with a Homomixer high-speed stirrer (PRIMIX Corporation) and a thermometer, and the temperature was raised to 60° C. while stirring at 12,000 rpm. To this was added an aqueous calcium chloride solution of 9.00 parts calcium chloride (dihydrate) dissolved in 65.00 parts deionized water, and stirring was carried out for 30 minutes at 12,000 while maintaining 60° C. To this was added 10% hydrochloric acid to adjust the pH to 6.0 and obtain an aqueous dispersion containing a dispersion stabilizer.

The starting material dispersion was transferred to a vessel equipped with a stirrer and thermometer, and the temperature was raised to 60° C. while stirring at 100 rpm. To this was added 8.00 parts of the polymerization initiator t-butyl peroxypivalate (PERBUTYL PV, NOF Corporation); stirring was performed for 5 minutes at 100 rpm while holding at 60° C.; and this was introduced into the aqueous dispersion that was being stirred at 12,000 rpm with the high-speed stirrer. A granulation solution was obtained by continuing to stir for 20 minutes at 12,000 rpm with the high-speed stirrer while holding at 60° C.

The granulation solution was transferred to a reactor equipped with a reflux condenser, stirrer, thermometer, and nitrogen introduction line, and the temperature was raised to 70° C. while stirring at 150 rpm under a nitrogen atmosphere. A polymerization reaction was run for 10 hours at 150 rpm while holding at 70° C. This was followed by removal of the reflux condenser from the reactor; raising the temperature of the reaction solution to 95° C.; and stirring for 5 hours at 150 rpm while holding at 95° C. to yield a toner particle dispersion.

The resulting toner particle dispersion was cooled to 20° C. while stirring at 150 rpm, and, while maintaining this stirring, dilute hydrochloric acid was then added to bring the pH to 1.5 and dissolve the dispersion stabilizer. The solid fraction was filtered off and thoroughly washed with deionized water, followed by vacuum drying for 24 hours at 40° C. to obtain a toner particle 1 containing a polymer 1 of the monomer composition.

Further, a polymer 1' was obtained in the same manner as in the method for producing the toner particles 1, except that C.I. Pigment Yellow 74, aluminum di-t-butylsalicylate, and Fischer-Tropsch wax were not used. The melting point was 62° C.

Since the polymer 1 and the polymer 1' were produced in the same manner, it was determined that they had the same physical properties.

Preparation of Toner 1

At external additive was added to the above toner particles 1. A toner 1 was obtained by dry mixing 1.8 parts of silica fine particles (hydrophobized with hexamethyldisilazane, average particle size of primary particles: 10 nm, BET specific surface area: 170 $m^2/g$) as an external additive with 100 parts of the toner particles 1 with a Henschel mixer (manufactured by Mitsui Mining Co., Ltd.) for 5 min. The physical properties of the obtained toner 1 are shown in Table 2, and the evaluation results are shown in Table 3.

TABLE 1

| Toner particle | | Polymerizable monomer | | | | | Resin other than polymer A | | Colorant | |
|---|---|---|---|---|---|---|---|---|---|---|
| | | MAN | AN | St | BA | BEA | | | | |
| No. | Production method | Parts | Parts | Parts | Parts | Parts | Type | Parts | Type | Parts |
| 1 | Suspension polymerization method | 30 | — | 35 | 25 | — | — | — | PY74 | 4 |
| 2 | Suspension polymerization method | 30 | — | 35 | 25 | — | — | — | SY162 | 4 |
| 3 | Suspension polymerization method | 30 | — | 35 | 25 | — | — | — | PR150 | 8 |
| 4 | Suspension polymerization method | 30 | — | 35 | 25 | — | — | — | PR57:1 | 8 |
| 5 | Suspension polymerization method | 30 | — | 35 | 25 | — | — | — | PY155 | 4 |
| 6 | Suspension polymerization method | 30 | — | 35 | 25 | — | — | — | PY17 | 4 |
| 7 | Suspension polymerization method | 30 | — | 35 | 25 | — | — | — | PY93 | 4 |
| 8 | Suspension polymerization method | 30 | — | 35 | 25 | — | — | — | PY180 | 4 |
| 9 | Suspension polymerization method | 30 | — | 35 | 25 | — | — | — | PY97 | 4 |
| 10 | Suspension polymerization method | 30 | — | 35 | 25 | — | — | — | PR176 | 8 |
| 11 | Suspension polymerization method | 15 | — | 60 | 25 | — | — | — | PY74 | 4 |
| 12 | Suspension polymerization method | 10 | — | 65 | 25 | — | — | — | PY74 | 4 |
| 13 | Suspension polymerization method | 70 | — | 5 | 25 | — | — | — | PY74 | 4 |
| 14 | Suspension polymerization method | 30 | — | 70 | — | — | — | — | PY74 | 4 |
| 15 | Suspension polymerization method | 30 | — | — | 70 | — | — | — | PY74 | 4 |
| 16 | Suspension polymerization method | 100 | — | — | — | — | Amorphous resin 1 | 50 | PY74 | 4 |
| 17 | Suspension polymerization method | 30 | — | 70 | — | — | Amorphous resin 2 | 55 | PY74 | 4 |
| 18 | Suspension polymerization method | 30 | — | 35 | 25 | — | — | — | PY74 | 1 |
| 19 | Suspension polymerization method | 30 | — | 35 | 25 | — | — | — | PY74 | 20 |
| 20 | Suspension polymerization method | 2 | — | 73 | 25 | — | — | — | PY74 | 4 |
| 21 | Suspension polymerization method | 8 | — | 67 | 25 | — | — | — | PY74 | 20 |
| 22 | Suspension polymerization method | 30 | — | 10 | 10 | 50 | — | — | PY74 | 4 |

TABLE 1-continued

| Toner particle No. | Production method | Polymerizable monomer MAN Parts | AN Parts | St Parts | BA Parts | BEA Parts | Resin other than polymer A Type | Parts | Colorant Type | Parts |
|---|---|---|---|---|---|---|---|---|---|---|
| 23 | Suspension polymerization method | 60 | — | 20 | 15 | 5 | — | — | PY74 | 4 |
| 24 | Suspension polymerization method | 20 | — | 5 | 5 | 70 | — | — | PY74 | 4 |
| Com. 1 | Suspension polymerization method | 1 | — | 74 | 25 | — | — | — | PY74 | 4 |
| Com. 2 | Suspension polymerization melhod | 7 | — | 67 | 25 | — | — | — | PY74 | 20 |
| Com. 3 | Suspension polymerization method | — | 30 | 35 | 25 | — | — | — | PY74 | 4 |
| Com. 4 | Suspension polymerization method | — | — | 75 | 25 | — | — | — | PY74 | 4 |
| Com. 5 | Suspension polymerization method | — | 30 | 10 | 10 | 50 | — | — | PY74 | 4 |
| Com. 6 | Suspension polymerization method | — | 30 | 35 | 25 | — | — | — | PR150 | 8 |

The abbreviations in the table are as follows.
MAN: Methacrylonitrile
AN: Acrylonitrile
St: Styrene
BA: Butyl acrylate
BEA: Behenyl acrylate
PY: C.I. Pigment Yellow
SY: C.I. Solvent Yellow
PR: C.I. Pigment Red
Com.: comparative

TABLE 2

| | Toner No. | Toner Particle No. | Toner D4 μm | Ratio of monomer units in polymer A MAN mol % | AN mol % | St mol % | BA mol % | BEA mol % | Colorant Type | Number of azo groups | Molecular weight | Parts | A × (Number of azo groups)/M | X |
|---|---|---|---|---|---|---|---|---|---|---|---|---|---|---|
| Ex. 1 | 1 | 1 | 6.2 | 45.9% | — | 34.1% | 20.0% | — | PY74 | 1 | 386.4 | 4 | 0.023 | 386.4 |
| Ex. 2 | 2 | 2 | 6.1 | 45.9% | — | 34.1% | 20.0% | — | SY162 | 1 | 486.6 | 4 | 0.018 | 486.6 |
| Ex. 3 | 3 | 3 | 6.2 | 45.9% | — | 34.1% | 20.0% | — | PR150 | 1 | 440.4 | 8 | 0.041 | 440.4 |
| Ex. 4 | 4 | 4 | 6.1 | 45.9% | — | 34.1% | 20.0% | — | PR57.1 | 1 | 425.6 | 8 | 0.042 | 425.6 |
| Ex. 5 | 5 | 5 | 6.2 | 45.9% | — | 34.1% | 20.0% | — | PY155 | 2 | 716.6 | 4 | 0.025 | 358.3 |
| Ex. 6 | 6 | 6 | 6.2 | 45.9% | — | 34.1% | 20.0% | — | PY17 | 2 | 654.1 | 4 | 0.027 | 327.0 |
| Ex. 7 | 7 | 7 | 6.3 | 45.9% | — | 34.1% | 20.0% | — | PY93 | 2 | 982.1 | 4 | 0.018 | 491.0 |
| Ex. 8 | 8 | 8 | 6.1 | 45.9% | — | 34.1% | 20.0% | — | PY180 | 2 | 732.7 | 4 | 0.024 | 366.4 |
| Ex. 9 | 9 | 9 | 6.3 | 45.9% | — | 34.1% | 20.0% | — | PY97 | 1 | 591.0 | 4 | 0.015 | 591.0 |
| Ex. 10 | 10 | 10 | 6.1 | 45.9% | — | 34.1% | 20.0% | — | PR176 | 1 | 572.6 | 8 | 0.031 | 572.6 |
| Ex. 11 | 11 | 11 | 6.2 | 22.6% | — | 57.7% | 19.7% | — | PY74 | 1 | 386.4 | 4 | 0.046 | 386.4 |
| Ex. 12 | 12 | 12 | 6.1 | 15.5% | — | 64.2% | 20.3% | — | PY74 | 1 | 386.4 | 4 | 0.069 | 386.4 |
| Ex. 13 | 13 | 13 | 6.1 | 81.1% | — | 3.7% | 15.2% | — | PY74 | 1 | 386.4 | 4 | 0.010 | 386.4 |
| Ex. 14 | 14 | 14 | 6.2 | 40.2% | — | 59.8% | 0.0% | — | PY74 | 1 | 386.4 | 4 | 0.023 | 386.4 |
| Ex. 15 | 15 | 15 | 6.3 | 45.0% | — | — | 55.0% | — | PY74 | 1 | 386.4 | 4 | 0.023 | 386.4 |
| Ex. 16 | 16 | 16 | 6.2 | 100.0% | — | — | 0.0% | — | PY74 | 1 | 386.4 | 4 | 0.007 | 386.4 |
| Ex. 17 | 17 | 17 | 6.1 | 40.2% | — | 59.8% | 0.0% | — | PY74 | 1 | 386.4 | 4 | 0.023 | 386.4 |
| Ex. 18 | 18 | 18 | 6.1 | 45.9% | — | 34.1% | 20.0% | — | PY74 | 1 | 386.4 | 1 | 0.006 | 386.4 |
| Ex. 19 | 19 | 19 | 6.2 | 45.9% | — | 34.1% | 20.0% | — | PY74 | 1 | 386.4 | 20 | 0.116 | 386.4 |
| Ex. 20 | 20 | 20 | 6.3 | 3.2% | — | 75.5% | 21.2% | — | PY74 | 1 | 386.4 | 4 | 0.347 | 386.4 |
| Ex. 21 | 21 | 21 | 6.1 | 12.5% | — | 67.0% | 20.5% | — | PY74 | 1 | 386.4 | 20 | 0.433 | 386.4 |
| Ex. 22 | 22 | 22 | 6.1 | 59.5% | — | 12.7% | 10.4% | 17.5% | PY74 | 1 | 386.4 | 4 | 0.023 | 386.4 |
| Ex. 23 | 23 | 23 | 6.2 | 73.6% | — | 15.7% | 9.6% | 1.1% | PY74 | 1 | 386.4 | 4 | 0.012 | 386.4 |
| Ex. 24 | 24 | 24 | 6.1 | 52.4% | — | 8.4% | 6.9% | 32.4% | PY74 | 1 | 386.4 | 4 | 0.035 | 386.4 |
| Com. Ex. 1 | Com. 1 | Com. 1 | 6.1 | 1.6% | — | 77.0% | 21.3% | — | PY74 | 1 | 386.4 | 4 | 0.694 | 386.4 |
| Com. Ex. 2 | Com. 2 | Com. 2 | 6.2 | 11.1% | — | 68.0% | 20.8% | — | PY74 | 1 | 386.4 | 20 | 0.495 | 386.4 |
| Com. Ex. 3 | Com. 3 | Com. 3 | 6.2 | — | 51.7% | 30.5% | 17.8% | — | PY74 | 1 | 386.4 | 4 | — | 386.4 |
| Com. Ex. 4 | Com. 4 | Com. 4 | 6.1 | — | — | 78.5% | 21.5% | — | PY74 | 1 | 386.4 | 4 | — | 386.4 |
| Com. Ex. 5 | Com. 5 | Com. 5 | 6.2 | — | 65.0% | 10.9% | 9.0% | 15.1% | PY74 | 1 | 386.4 | 4 | — | 386.4 |
| Com. Ex. 6 | Com. 6 | Com. 6 | 6.1 | — | 51.7% | 30.5% | 17.8% | — | PR150 | 1 | 440.4 | 8 | — | 440.4 |

In the table, X indicates "(molecular weight of azo dye)/(number of azo groups)", "Ex." indicates Example, and "Com." indicates comparative.

Examples 2 to 24

Toner particles 2 to 24 were obtained in the same manner as in Example 1, except that the type and addition amount of the monomer composition used, the resin other than the polymer A, and the type and addition amount of the azo dye were changed as shown in Table 1. Resins other than the polymer A were added at the stage of adjusting the mixture.

Further, the same external addition as in Example 1 was performed to obtain toners 2 to 24. The physical properties are shown in Table 2, and the evaluation results are shown in Table 3.

Comparative Examples 1 to 6

Comparative particles 1-6 were obtained in the same manner as in Example 1, except that the type and addition amount of the monomer composition used, the resin other than the polymer A, and the type and addition amount of the azo dye were changed as shown in Table 1. Further, the same external addition as in Example 1 was performed to obtain comparative toners 1 to 6.

The physical properties are shown in Table 2, and the evaluation results are shown in Table 3.

Evaluation of Toner

The tandem system Canon laser beam printer LBP9600C having the configuration shown in FIG. 1 was modified to change the process speed to 310 mm/sec and enable printing with a cyan station alone. The toner cartridge for LBP9600C was filled with 200 g of the toner to be evaluated.

The symbols in the figure are as follows.

1: photosensitive member; 2: developing roller; 3: toner supplying roller; 4: toner; 5: control blade, 6: developing apparatus; 7: laser light; 8: charge apparatus; 9: cleaning apparatus; 10: charge apparatus for cleaning; 11: stirring blade; 12: drive roller; 13: transfer roller; 14: bias power supply; 15: tension roller; 16: transfer conveying belt; 17: driven roller; 18: paper; 19: paper feed roller; 20: absorbing roller; 21: fixing apparatus.

<1>Transfer Roughness

The entire toner cartridge was allowed to stand for 24 h in a high-temperature and high-humidity (temperature 32.5° C., relative humidity 85%) environment. The toner cartridge after being allowed to stand for 24 h was attached to the LBP9600C, and images with a print percentage of 1.0% were printed on up to 5000 sheets in the horizontal direction of A4 paper. After outputting 5000 sheets, a solid image with a toner bearing amount of 0.40 mg/cm$^2$ was outputted to CS-680 (basis weight 68 g/m$^2$, sold by Canon Marketing Japan Inc.).

This image was visually observed and the transfer roughness was evaluated based on the following criteria. In this disclosure, the portion where the image uniformity was impaired was determined to be a transfer roughness. C or higher was determined to be good.

(Evaluation Criteria)

A: No transfer roughness can be seen even under normal light or when held over strong light.

B: No transfer roughness can be seen under normal light, but transfer roughness can be seen when held over strong light.

C: Even under normal light, transfer roughness can be seen in 1-3 places, but no blank dots can be seen.

D: Even under normal light, transfer roughness can be seen in at least 4 places, or blank dots can be seen in at least 1 place.

<2>Tinting Strength

The entire toner cartridge was allowed to stand at room temperature and humidity (temperature 23° C., relative humidity 50%) for 24 h.

The toner cartridge after being allowed to stand for 24 h was attached to the LBP9600C, a solid image with a toner bearing amount of 0.50 mg/cm$^2$ on the evaluation paper was outputted, and the image density was measured and evaluated using a color reflection densitometer (X-RITE 404A: manufactured by X-Rite Co.). C or higher was determined to be good.

(Evaluation Criteria)

A: Image density is at least 1.40,

B: Image density is at least 1.35 and less than 1.40,

C: Image density is at least 1.20 and less than 1.35,

D: Image density is less than 1.20,

<3>Gloss

The fixing unit of the modified Canon laser beam printer LBP9600C was further modified so that the fixing temperature could be adjusted.

The entire toner cartridge was allowed to stand at normal temperature and normal humidity (temperature 23° C., relative humidity 50%) environment for 24 hours.

The toner cartridge after being allowed to stand for 24 hours was attached to the LBP9600C, and a solid full-region image (tip margin: 5 mm, toner bearing amount 0.50 mg/cm$^2$) was outputted on a Xerox business 4200 (75 g/m$^2$) at a set temperature of 170° C. A 75° gloss of each section obtained by dividing the inside of the fixed image into 9 equal parts was measured, and the average value was calculated and evaluated according to the following criteria.

The gloss value measuring device used was PG-3D (incident angle θ=75°) manufactured by Nippon Denshoku Kogyo Co., Ltd., and the standard surface used was black glass with a gloss value of 96.9. C or higher was determined to be good.

(Evaluation Criteria)

A: 75° gloss average value is at least 23.0.

B: 75° gloss average value is at least 18.0 and less than 23.0.

C: 75° gloss average value is at least 13.0 and less than 18.0.

D: 75° gross average value is less than 13.0.

TABLE 3

| | High temperature, high humidity | Normal temperature, normal humidity | |
|---|---|---|---|
| | Transfer roughness | Tinting strength | Gloss |
| Ex. 1 | A | A<br>1.50 | B<br>22.5 |
| Ex. 2 | A | A<br>1.45 | B<br>22.5 |
| Ex. 3 | A | A<br>1.44 | B<br>22.4 |
| Ex. 4 | A | A<br>1.45 | B<br>22.2 |
| Ex. 5 | A | A<br>1.41 | B<br>20.5 |
| Ex. 6 | A | A<br>1.42 | B<br>21.2 |
| Ex. 7 | A | A<br>1.40 | B<br>20.4 |
| Ex. 8 | A | A<br>1.41 | B<br>20.4 |
| Ex. 9 | A | B<br>1.38 | B<br>19.0 |
| Ex. 10 | A | B<br>1.39 | B<br>18.5 |
| Ex. 11 | A | A<br>1.40 | B<br>22.0 |
| Ex. 12 | A | B<br>1.39 | B<br>21.6 |
| Ex. 13 | B | A<br>1.50 | B<br>21.6 |
| Ex. 14 | A | A<br>1.50 | B<br>18.5 |
| Ex. 15 | A | A<br>1.50 | B<br>21.2 |
| Ex. 16 | C | B<br>1.35 | B<br>19.1 |
| Ex. 17 | B | C<br>1.31 | C<br>15.1 |
| Ex. 18 | A | C<br>1.20 | B<br>18.5 |
| Ex. 19 | A | A<br>1.45 | C<br>15.2 |
| Ex. 20 | A | C<br>1.21 | C<br>17.1 |

TABLE 3-continued

| | High temperature, high humidity | Normal temperature, normal humidity | |
|---|---|---|---|
| | Transfer roughness | Tinting strength | Gloss |
| Ex. 21 | A | B<br>1.37 | C<br>13.1 |
| Ex. 22 | A | A<br>1.42 | A<br>25.4 |
| Ex. 23 | A | A<br>1.46 | A<br>23.5 |
| Ex. 24 | A | B<br>1.35 | A<br>27.1 |
| Com. Ex. 1 | A | D<br>1.18 | C<br>16.5 |
| Com. Ex. 2 | A | C<br>1.33 | D<br>12.8 |
| Com. Ex. 3 | D | A<br>1.45 | B<br>21.4 |
| Com. Ex. 4 | A | D<br>1.18 | C<br>17.1 |
| Com. Ex. 5 | D | A<br>1.42 | B<br>22.9 |
| Com. Ex. 6 | D | A<br>1.40 | B<br>20.1 |

In the Tables, "Ex." indicates Example, and "Com." indicates comparative.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-224126, filed Nov. 12, 2019, which is hereby incorporated by reference herein in its entirety.

What is claimed is:

1. A toner, comprising:

a toner particle, said toner particle comprising an azo dye and a binder resin, the binder resin comprising a polymer A, polymer A being a polymer having a monomer unit derived from methacrylonitrile, wherein

[(amount of substance of azo dye (mol))×(number of azo groups in azo dye)/(amount of substance of monomer unit derived from methacrylonitrile (mol)]≤0.500.

2. The toner according to claim 1, wherein the amount of polymer A in the binder resin is at least 50.0% by mass.

3. The toner according to claim 1, wherein polymer A has a monomer unit derived from a vinyl-based monomer represented by formula (Z)

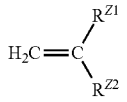

(Z)

where $R^{Z1}$ represents a hydrogen atom or an alkyl group, and $R^{Z2}$ represents an alkyl group having 1 to 12 carbon atoms or a phenyl group.

4. The toner according to claim 1, wherein 0.010≤[(amount of substance of azo dye (mol))×(number of azo groups in azo dye)/(amount of substance of monomer unit derived from methacrylonitrile (mol))]≤0.500.

5. The toner according to claim 1, wherein [(molecular weight of azo dye)/(number of azo groups)] is not more than 500.0.

6. The toner according to claim 1, wherein the azo dye comprises at least one yellow colorant selected from the group consisting of C.I. Pigment Yellow 17, C.I. Pigment Yellow 74, C.I. Pigment Yellow 93, C.I. Pigment Yellow 151, C.I. Pigment Yellow 155 and C.I. Pigment Yellow 180.

7. The toner according to claim 1, wherein the azo dye has a molecular weight of not more than 500.

8. The toner according to claim 1, wherein polymer A comprises a monomer unit B derived from at least one member selected from the group consisting of (meth)acrylic acid esters having an alkyl group having 18 to 36 carbon atoms.

9. The toner according to claim 8, wherein monomer unit B is present in polymer A at 1.0 to 50.0 mol %.

10. The toner according to claim 1, wherein the azo dye is present at 1 to 20 parts by mass with respect to 100 parts by mass of the binder resin.

11. The toner according to claim 1, wherein polymer A is a vinyl-based polymer.

12. A toner, comprising:

a toner particle comprising an azo dye and a binder resin the binder resin comprising a polymer A, polymer A being a polymer obtained by polymerizing a polymerizable monomer composition comprising methacrylonitrile, wherein

[(amount of substance of azo dye (mol))×(number of azo groups in azo dye)/(amount of substance of monomer unit derived from methacrylonitrile (mop)]≤0.500.

* * * * *